US011964809B2

(12) United States Patent
Vernier et al.

(10) Patent No.: US 11,964,809 B2
(45) Date of Patent: Apr. 23, 2024

(54) FOOD PRODUCT PACKAGE FORMED BY A SHEET SEALED ON ITSELF, METHOD FOR MANUFACTURING AND FILLING SUCH A PACKAGING AND BLANK

(71) Applicant: BEL, Suresnes (FR)

(72) Inventors: Alexandre Vernier, Naveil (FR); Gilles Coupard, Areines (FR)

(73) Assignee: BEL, Suresnes (FR)

( * ) Notice: Subject to any disclaimer, the term of this patent is extended or adjusted under 35 U.S.C. 154(b) by 0 days.

(21) Appl. No.: 17/759,367

(22) PCT Filed: Jan. 21, 2021

(86) PCT No.: PCT/EP2021/051319
§ 371 (c)(1),
(2) Date: Jul. 22, 2022

(87) PCT Pub. No.: WO2021/148526
PCT Pub. Date: Jul. 29, 2021

(65) Prior Publication Data

US 2023/0348164 A1 Nov. 2, 2023

(30) Foreign Application Priority Data

Jan. 22, 2020 (FR) ..... 2000610

(51) Int. Cl.
*B65D 75/20* (2006.01)
*B65B 11/48* (2006.01)
(Continued)

(52) U.S. Cl.
CPC ..... *B65D 75/20* (2013.01); *B65B 11/48* (2013.01); *B65B 25/068* (2013.01); *B65D 75/42* (2013.01);
(Continued)

(58) Field of Classification Search
CPC .... B65D 75/20; B65D 75/42; B65D 75/5833; B65D 75/66; B65D 85/76; B65B 11/48; B65B 25/068
(Continued)

(56) References Cited

U.S. PATENT DOCUMENTS 2,213,758 A * 9/1940 Eichberg ..... B65D 75/5833 206/264
4,015,021 A 3/1977 Harima et al.
(Continued)

FOREIGN PATENT DOCUMENTS

CH 339565 A 6/1959
CH 342156 A 10/1959
(Continued)

OTHER PUBLICATIONS

"Façonnage des papiers couchés imprimés . . . ".
(Continued)

*Primary Examiner* — Jes F Pascua
(74) *Attorney, Agent, or Firm* — MARSHALL, GERSTEIN & BORUN LLP

(57) ABSTRACT

A food product package is formed by a sheet resulting from a blank with a plurality of sheets, each sheet of the blank having weakened portions, and a tongue secured to a transverse edge of the sheet The sheet is folded according to transverse weakened portions in order to form a tube with a rectangular cross-section and being sealed on itself along a peelable or tearable transverse joint, the tongue projecting longitudinally from the transverse joint, the sheet being sealed longitudinally along a longitudinal base joint, and the package being closed by longitudinally sealing the sheet on itself along a longitudinal top joint spaced apart from the longitudinal base joint, with the transverse joint extending from one longitudinal joint to the other.

13 Claims, 14 Drawing Sheets

(51) Int. Cl.

| | |
|---|---|
| ***B65B 25/06*** | (2006.01) |
| ***B65D 75/42*** | (2006.01) |
| ***B65D 75/58*** | (2006.01) |
| ***B65D 75/66*** | (2006.01) |
| ***B65D 85/76*** | (2006.01) |

(52) U.S. Cl.
CPC ..... *B65D 75/5833* (2013.01); *B65D 75/66* (2013.01); *B65D 85/76* (2013.01)

(58) Field of Classification Search
USPC ..... 229/87.08
See application file for complete search history.

(56) References Cited

U.S. PATENT DOCUMENTS

| | | | |
|---|---|---|---|
| 5,582,342 | A | 12/1996 | Jud |
| 2005/0155877 | A1 | 7/2005 | Pham |
| 2006/0231598 | A1 | 10/2006 | Dal et al. |
| 2017/0217610 | A1 | 8/2017 | Kowalewski et al. |

FOREIGN PATENT DOCUMENTS

| | | | | |
|---|---|---|---|---|
| CN | 1092730 | A | | 9/1994 |
| CN | 1178755 | A | | 4/1998 |
| CN | 105564815 | A | | 5/2016 |
| CN | 105745155 | A | | 7/2016 |
| CN | 105745162 | A | | 7/2016 |
| DE | 4121914 | A1 | * | 1/1992 |
| EP | 0185897 | A1 | | 7/1986 |
| FR | 2499025 | A1 | | 8/1982 |
| FR | 2854388 | B1 | | 8/2005 |
| FR | 2880869 | A1 | | 7/2006 |
| FR | 2957062 | A1 | | 9/2011 |
| FR | 3106341 | B1 | | 1/2022 |
| GB | 124197 | A | * | 10/1919 |
| JP | H07101463 | A | | 4/1995 |
| WO | WO-2011/058237 | A1 | | 5/2011 |
| WO | WO-2014064619 | A1 | * | 5/2014 ..... B65D 65/14 |

OTHER PUBLICATIONS

Search Report for FR 2000610, dated Jul. 30, 2020.
International Search and Written Opinion for PCT/EP2021/051319, dated Jun. 1, 2021.
International Preliminary Report on Patentability for PCT/EP2021/051319, dated Jul. 26, 2022.
"Folding and creasing Converting coated paper for sheet-fed offset printing" Sappi, www.sappi.com/KnowledgeBank, 2006.

* cited by examiner

FOOD PRODUCT PACKAGE FORMED BY A SHEET SEALED ON ITSELF, METHOD FOR MANUFACTURING AND FILLING SUCH A PACKAGING AND BLANK

FIELD

Technical Field

The present invention relates to a food product package.

Background

Processed and fresh processed cheeses are often presented in individually wrapped portions. The portion packs are typically made of thin aluminium foil, folded to form an open container in which the cheese is dosed while hot. An aluminium cover is then placed on the cheese, and the whole product is sealed. These portions have an easy opening system made by means of a plastic tear guide strip glued into the package before it is formed.

Such portion packs are economical to produce and provide a relative seal, allowing the products mentioned to be preserved satisfactorily under difficult logistical conditions. Thus, it is possible to offer processed cheeses with a shelf life of more than 6 months and up to 1 year with transport and storage at room temperature even in hot countries.

However, the sealing of this type of packaging is not perfect. Over time, a loss of product weight can be observed through evaporation of some of its water, which demonstrates the existence of leakage in the packaging.

The way in which the cover is sealed onto the cheese and the prior folding is carried out creates chimneys into which the cheese can enter, water can evaporate, and sometimes serum released by the cheese can leak out.

These leaks have a negative impact on the conservation of the product. Indeed, the loss of water during storage alters the texture of the product and requires extra to be included during packaging. Leakage also allows oxygen to enter the packaging and limits the shelf life by making the product rancid. The flow of serum and the proximity of the cheese to the outside environment can cause mould to appear on the outside of the packaging, which presents an unpleasant appearance for the consumer even if the product is not spoiled in the packaging.

JP H07-101463 describes a package formed from a sheet sealed to itself containing, for example, sliced cheese. However, after the package has been filled with hot, liquid cheese and then sealed to close, the package containing the cheese must be shaped between two rollers and cooled to form slices, which slows down the rate of production.

WO 2011/058237 describes a foldable package of a portionable food product, comprising a side strip having two longitudinal edges connected by two end edges, and having at least one curvature and/or fold to provide a storage space for the food product, and a lid peelably attached to the end edges. However, such a package requires the side strip and the lid to be made separately and to be assembled in a peelable manner by at least three successive seals, which are complex to implement. In addition, the package formed in this way has a large sealing surface, increasing the risk of leakage.

FR 2957062 describes a package of the aforementioned type, in particular for a portion of cheese, the package comprising a bottom and side walls folded back perpendicularly to the bottom and forming with the bottom a hermetic cavity, the package further comprising a lid secured to a side wall folded back and sealed on fixing flats of the other side walls. However, the blank required to produce this packaging unit by unit has many cuts that result in significant material waste and mechanical complexity in forming the packaging. Furthermore, as in WO 2011/058237, the package thus formed has a large sealing surface which increases the risk of leakage.

SUMMARY

One objective of the invention is to provide a package for food products that overcomes the above disadvantages and has a good sealing quality, is easy to produce and maintains high production rates.

To this end, the invention relates to a package for a food product formed from a sheet from a blank with a plurality of sheets joined together by a longitudinal edge, each sheet being intended to form a package,

- each sheet of the blank having weakened portions including transverse weakened portions, and a tongue secured to a transverse edge of the sheet,
- each sheet of the blank being folded along the transverse weakened portions to form a tube of rectangular cross-section and sealed to itself along a peelable or tearable transverse joint, with the tongue projecting longitudinally from the transverse joint,
- each sheet of the blank being sealed longitudinally along a longitudinal base joint thereby defining an internal cavity suitable for containing a food product,
- the food product being poured into the inner cavity, and
- the package being closed by longitudinally sealing the sheet to itself along a longitudinal top joint spaced from the longitudinal base joint, the transverse joint extending from one longitudinal joint to the other.

The invention allows the packaging to be made up, even when empty, from a single sheet. It is thus possible to use the packaging directly as a mould for a food product that would be deposited in liquid form in the packaging before it is sealed, which allows production savings by avoiding a forming stage for the food product before the packaging stage and thus maintaining high production rates.

Another advantage of the invention is hygiene and preservation. By pouring the product directly into the packaging, it is only minimally exposed to the ambient air, limiting the risk of contamination. If, in addition, the product is poured at a temperature higher than the pasteurisation temperature, between 60° C. and 90° C. at atmospheric pressure, the preservation is further improved.

According to particular embodiments of the invention, the packaging also has one or more of the following features taken in isolation or in any combination that is technically possible:

- the tongue has a free gripping end, the sheet having longitudinal tear guide strips, each opening at one end into a transverse edge of the sheet opposite the tongue and at another end into the free end of the tongue;
- the sheet is predominantly made of paper, cardboard or plastic, or a complex comprising one or more layers of paper and plastic, or one or more layers of plastic and aluminium, or several layers of plastic, or one or more layers of paper, plastic and aluminium;
- the weakened portions of the sheet comprise at least four longitudinal weakened portions, four transverse weakened portions and eight additional weakened portions, two of the four longitudinal weakened portions and the eight additional weakened portions being for the formation of two longitudinal gussets or four points projecting longitudinally outwards from the two longitudinal joints;

the packaging has a partial parallelepiped shape formed by four faces and two longitudinal gussets or four points projecting longitudinally outwards from the two longitudinal joints;

the packaging has a parallelepiped shape in which the two longitudinal gussets or the four points projecting longitudinally outwards from the two longitudinal joints are folded over;

the sheet further has a transverse weakened portion along which the sheet is folded towards the outside of the package to form a sealing hem under the transverse joint;

the sheet has at least two primers to facilitate the opening of the package, the transverse joint being tearable.

The invention further relates to a method for manufacturing and filling at least one package for a food product, comprising at least the following steps:

a step of providing a blank with a plurality of sheets joined together at a longitudinal edge, each sheet being intended to form a package, each sheet having weakened portions comprising transverse weakened portions, and a tongue joined to a transverse edge of the sheet, a step of folding the blank along the transverse weakened portions of each sheet to form a tube of rectangular cross-section and transversely sealing the blank to itself to form a peelable or tearable transverse joint, the tongue of each sheet projecting longitudinally from the transverse joint, and, for each sheet, a step of longitudinally sealing each sheet to form a longitudinal base joint thereby defining an inner cavity suitable for containing a food product, a step of filling the inner cavity with food product, and a step of closing the package by longitudinally sealing the sheet to itself to form a longitudinal top joint spaced from the longitudinal base joint, the transverse joint extending from one longitudinal joint to the other, the longitudinal top joint of the sheet forming the longitudinal base joint of the next sheet.

According to particular embodiments of the invention, the method for manufacturing and filling the package also has one or more of the following features taken in isolation or in any combination that is technically possible:

the method further comprises, simultaneously with or after the step of closing the package, an additional step of separating two successive packages by cutting;

the method further comprises, simultaneously with or after the step of closing the package, a further step of forming a longitudinal pre-cut between two successive packages;

during the filling stage, the food product is poured in a liquid or viscous state and solidifies in the package;

the blank is supplied in reel form, the method further comprising, prior to the blank folding step, a blank unwinding sub-step, and, for each sheet, a tear guide strip forming sub-step, a weakened portion forming sub-step, a tongue forming sub-step and optionally a primer forming sub-step.

The invention also relates to a package that can be obtained by the method as described above.

The invention also relates to a blank with a plurality of sheets for forming at least one package as described above, each sheet of the plurality of sheets having weakened portions including transverse weakened portions, and a tongue secured to a transverse edge of the sheet.

BRIEF DESCRIPTION OF THE DRAWINGS

Other characteristics and advantages of the invention will become apparent upon reading the following description, given only as an example and referencing the attached drawings, in which:

FIG. 5 shows a package being formed from the tube shown in FIG. 4, before sealing the tongue shown sealed in FIG. 4, FIG. 6 shows the package at one end of the tube in FIG. 4 after sealing the tongue and at the time of filling, one side is open, the other has a side seal, FIG. 7 shows the package just after filling, side sealing and cutting to separate the package from the tube, and FIG. 8 shows the closed package after the side seals have been folded over.

DESCRIPTION

Figure 1:
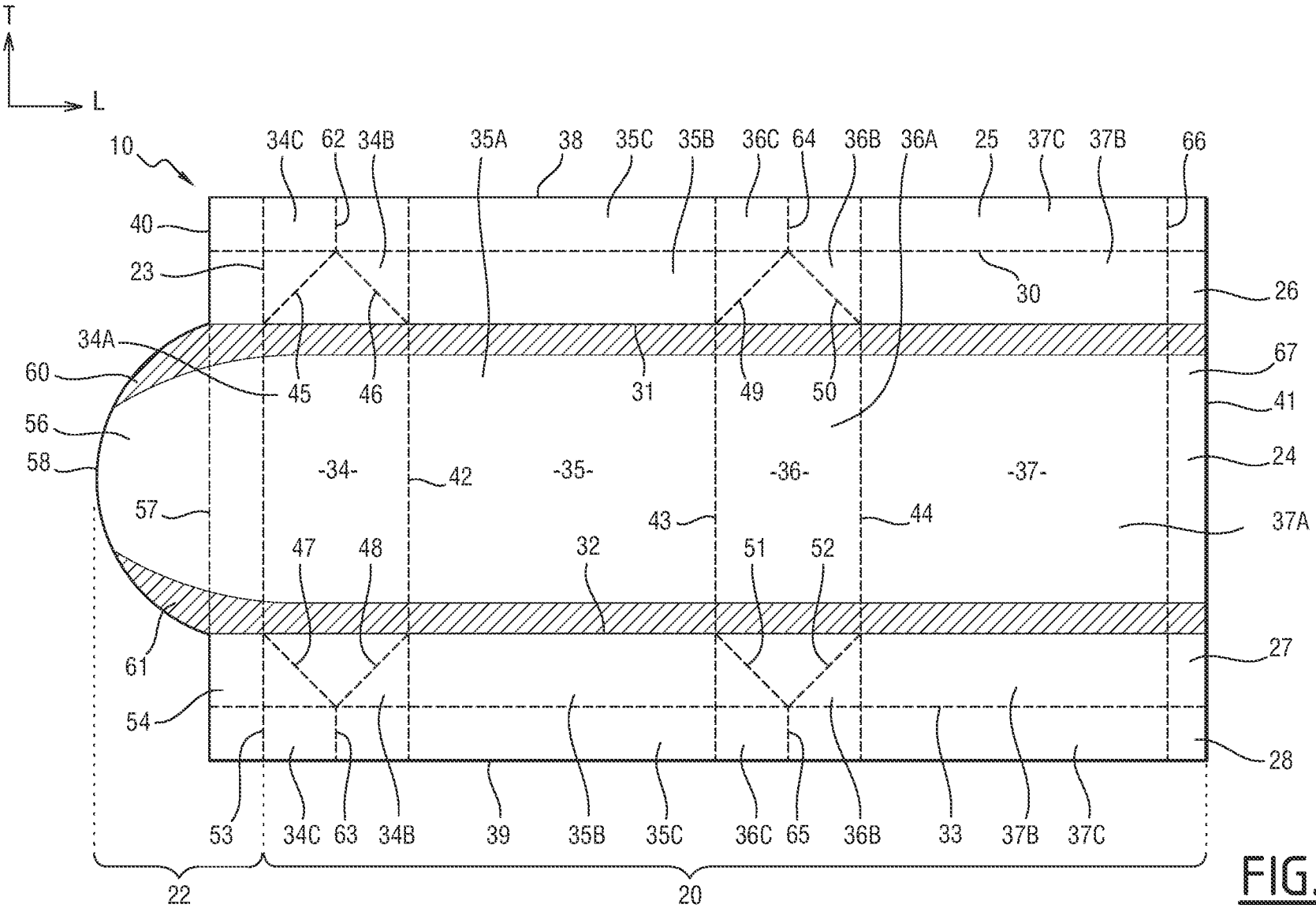
FIG. 1 is a bottom view of a sheet, laid flat, to form a package according to a preferred embodiment of the invention.

The sheet 10 of FIG. 1 is intended to form the packaging 12 of FIGS. 5 to 9.

Figure 10:
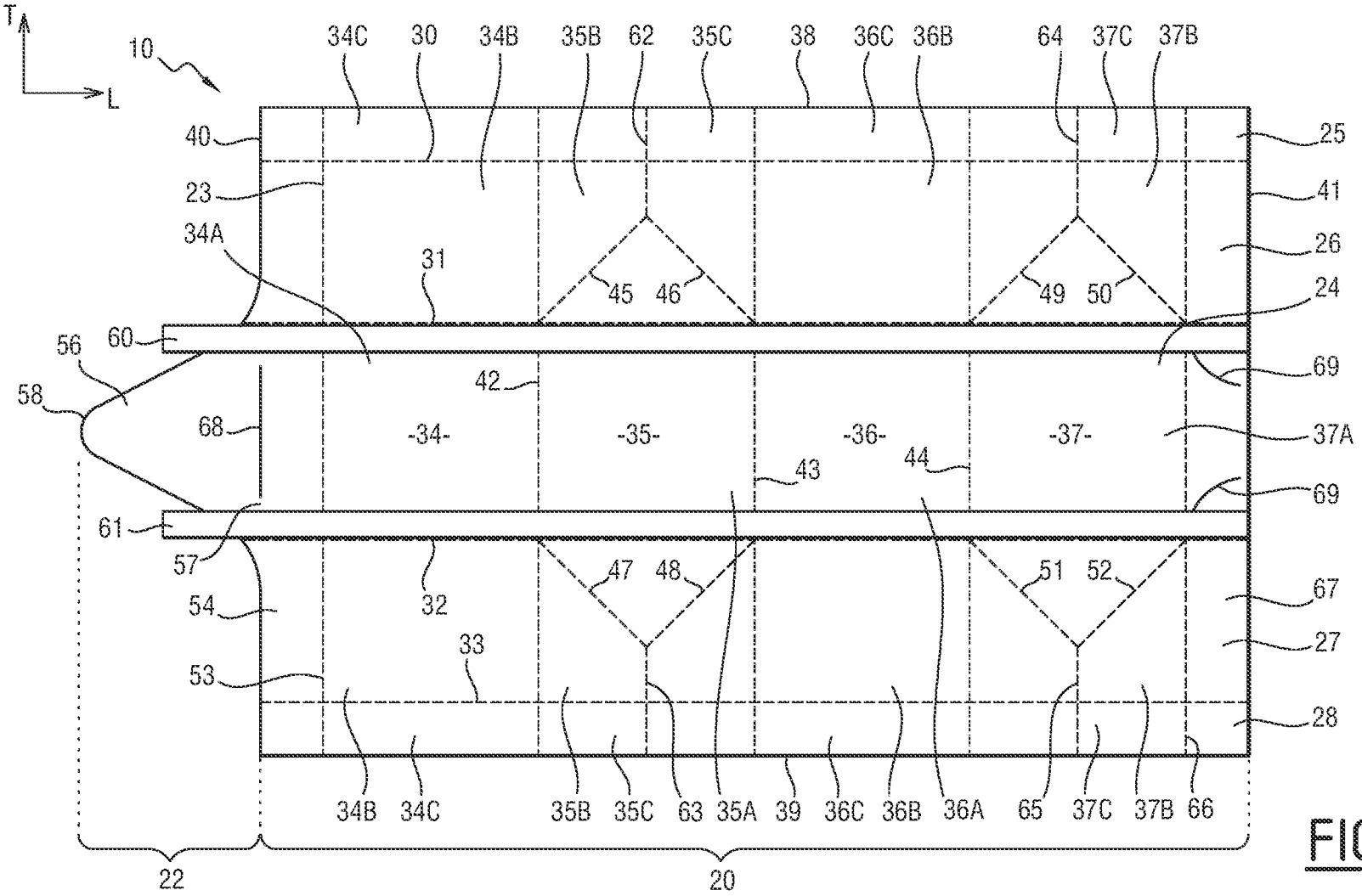
FIG. 10 is a bottom view of a sheet, laid flat, to form a package according to a first embodiment of FIG. 1.
Figure 11:
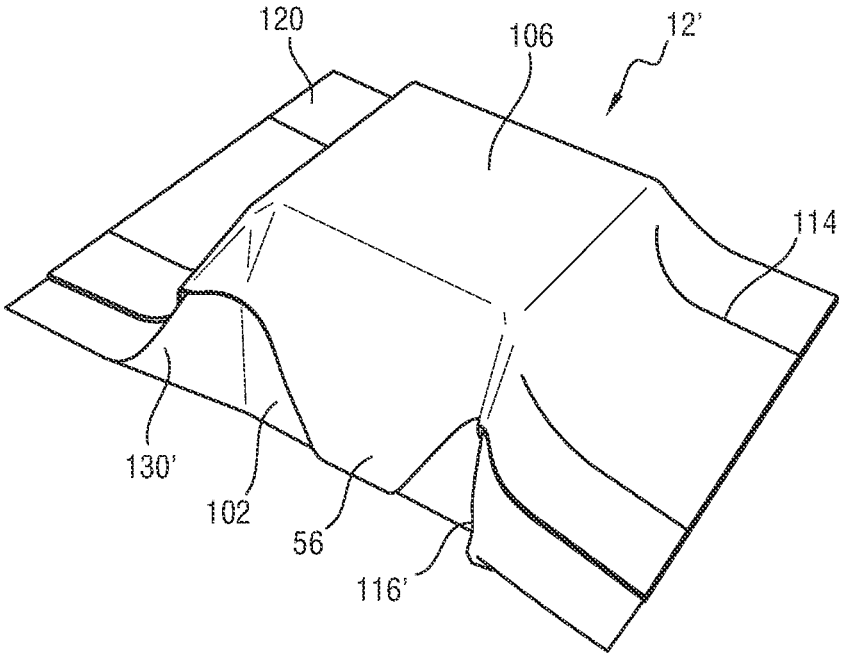
FIG. 11 is a perspective view of a package being formed from the sheet of FIG. 10.
Figure 12:
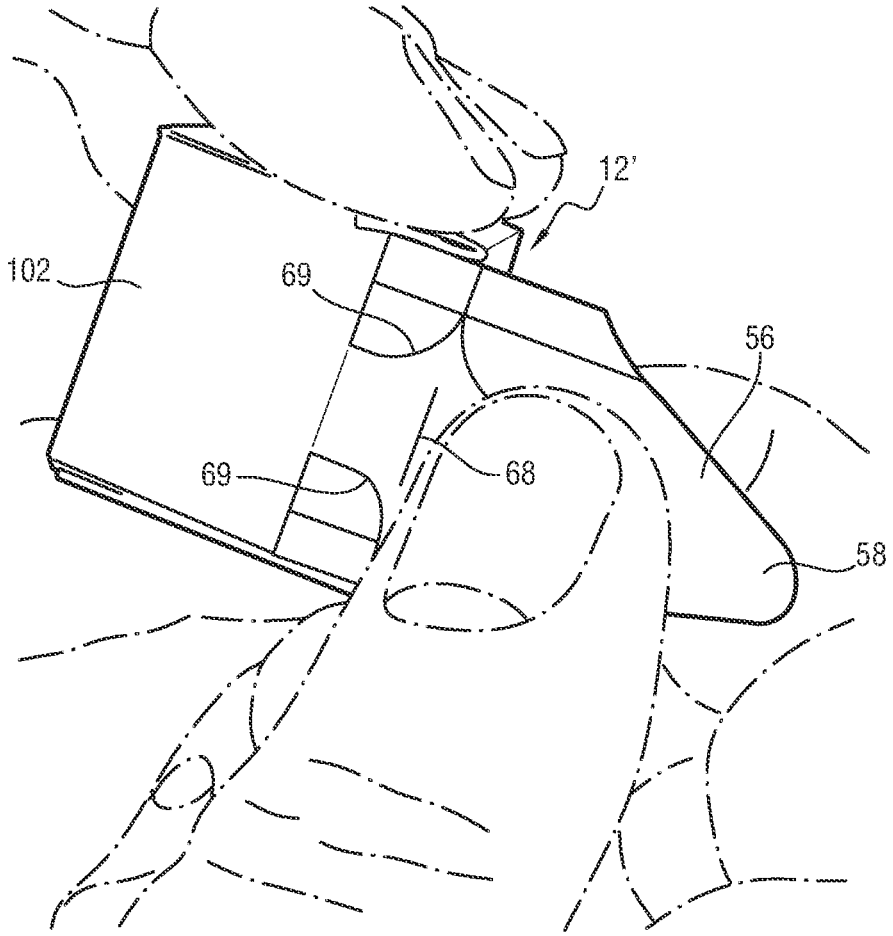
FIG. 12 is a view of the package of FIG. 11 as it is being opened.

The sheet 10 of FIG. 10 is intended for the packaging 12' of FIGS. 11 and 12.

The sheet 10 is elongated along a longitudinal direction L.

The sheet 10 is made of a material with a stiffness contrast between the weakened portions and the material outside the weakened portions, which is stiffer than the weakened portions.

It is understood that the material is of sufficient stiffness to form flat surfaces, and whose stiffness may be locally reduced by weakened portion.

Preferably, the sheet 10 consists mainly of paper or cardboard.

The paper or cardboard has a weight of between 30 g/m$^2$ and 200 g/m$^2$.

Preferably, the paper or cardboard has a weight of between 40 g/m$^2$ and 150 g/m$^2$.

Even more preferably, the paper or cardboard has a weight of between 40 g/m$^2$ and 80 g/m$^2$.

In another embodiment, the sheet 10 is made of a plastic material created by assembling different materials, forming a plastic complex. Materials eligible for inclusion in this complex include polyethylene terephthalate (PET) film, polyethylene (PE) film, polypropylene (PP) film, polyamide (PA) film, polylactic acid (PLA) film or any other plastic film commonly used for food packaging.

Advantageously, PET or PP are preferred to fulfil a structural role of the material when it comprises other layers such as lacquers, PE film, PP film, or a sealing polymer with a sealing aid function.

The sheet 10 may also comprise layers of aluminium and/or paper. These materials have the advantage of having sufficient rigidity to form flat surfaces, and of possessing folding properties of interest to the application, notably the ability to maintain a fold, and to form preferential weakened portions after the material is crushed.

When paper or cardboard is used, it is necessary to treat it all the way through or on the surface to give it water barrier properties, possibly gas barrier properties and the possibility of sealing.

Typical possible compositions for the sheet are, from the inside to be turned towards a food product P contained in the package 12, 12' to the outside:

Sealing and possibly water and gas barrier layer/Paper 40-80 g/m$^2$/Sealing and/or protective layer;

Sealing and possible water and gas barrier layer/Paper 40-80 g/m$^2$/Aluminium 10-20 μm/Sealing and/or protective layer;

Sealing and possibly water and gas barrier layer/PET 10-20 μm/Sealing and/or protective layer;

Sealing and possibly water and gas barrier layer/PET 10-20 μm/Paper 40-80 g/m$^2$/Sealing and/or protective layer;

Sealing and possibly water and gas barrier layer/PET 10-20 μm/Aluminium 10-20 μm/Sealing and/or protective layer;

Sealing and possibly water and gas barrier layer/PET 10-20 μm/Aluminium 10-20 μm/Paper 40-80 g/m$^2$/Sealing and/or protective layer;

The sealing and possibly water and gas barrier layer comprises for example at least one sealing lacquer, which can be supplemented or replaced by a polyolefin-based plastic coating or lamination.

Sealing lacquers are, for example, acrylic (methacrylate, acrylate, copolymer of these polymers with ethylene), nitrocellulose, vinyl (polyvinyl chloride (PVC), polyvinyl acetate (PVacetate), polyvinyl laurate (PVLaurate), polyvinylidene chloride (PVDC)), polyester-based lacquers, and polyolefin-based lacquers.

The sealing and/or protective layer comprises for example at least one sealing lacquer from the examples listed above, also fulfilling the protective function, or at least one sealing lacquer from the examples listed above and at least one protective lacquer different from the sealing lacquer, e.g. a polyvinyl alcohol lacquer (PVOH).

The sheet 10 advantageously has a total thickness of between 50 μm and 250 μm, preferably between 50 μm and 120 μm.

The sheet 10 comprises a main region 20 and an end region 22 disposed at a longitudinal end 23 of the main region 20.

The main region 20 is typically generally rectangular in shape.

The main region 20 comprises five transverse panels 24, 25, 26, 27, 28, a central panel 24 and four side panels 25, 26, 27, 28 arranged in pairs on either side of the central panel 24 along a transverse direction T substantially perpendicular to the longitudinal direction L.

The five transverse panels 24, 25, 26, 27, 28 are connected to each other by longitudinal weakened portions 30, 31, 32, 33 extending substantially parallel to the longitudinal direction L.

Hereafter, the two side panels 26, 27 connected to the central panel 24 are called proximal side panels 26, 27, the other two side panels 25, 28 are called distal side panels 25, 28.

Preferably, the two proximal side panels 26, 27 are substantially identical in shape and size.

Preferably, the two distal side panels 25, 28 are substantially identical in shape and size.

In other words, the sheet 10 is advantageously symmetrical with respect to a median longitudinal plane (not shown).

The main region 20 further comprises within the transverse panels 24, 25, 26, 27, 28 four longitudinal panels 34, 35, 36, 37 extending substantially parallel to the transverse direction T.

The sheet 10 has two longitudinal edges 38, 39 and two transverse edges 40, 41.

The four longitudinal panels 34, 35, 36, 37 each extend from one longitudinal edge 38 of the sheet 10 to the other longitudinal edge 39.

The four transverse panels 34, 35, 36, 37 are connected to each other by transverse weakened portions 42, 43, 44 extending substantially parallel to the transverse direction T.

The four longitudinal panels 34, 35, 36, 37 each comprise a central part 34A, 35A, 36A, 37A, two proximal side parts 34B, 35B, 36B, 37B and two distal side parts 34C, 35C, 36C, 37C arranged in pairs on either side of the central part 34A, 35A, 36A, 37A in the transverse direction T and connected by the longitudinal weakened portions 30, 31, 32, 33.

The transverse weakened portions 42, 43, 44 open into the two longitudinal edges 38, 39 of the sheet 10.

Preferably, the two longitudinal panels 34, 35 closest to the end region 22 are substantially identical in shape and size to the two longitudinal panels 36, 37 furthest from the end region 22.

Figure 13:
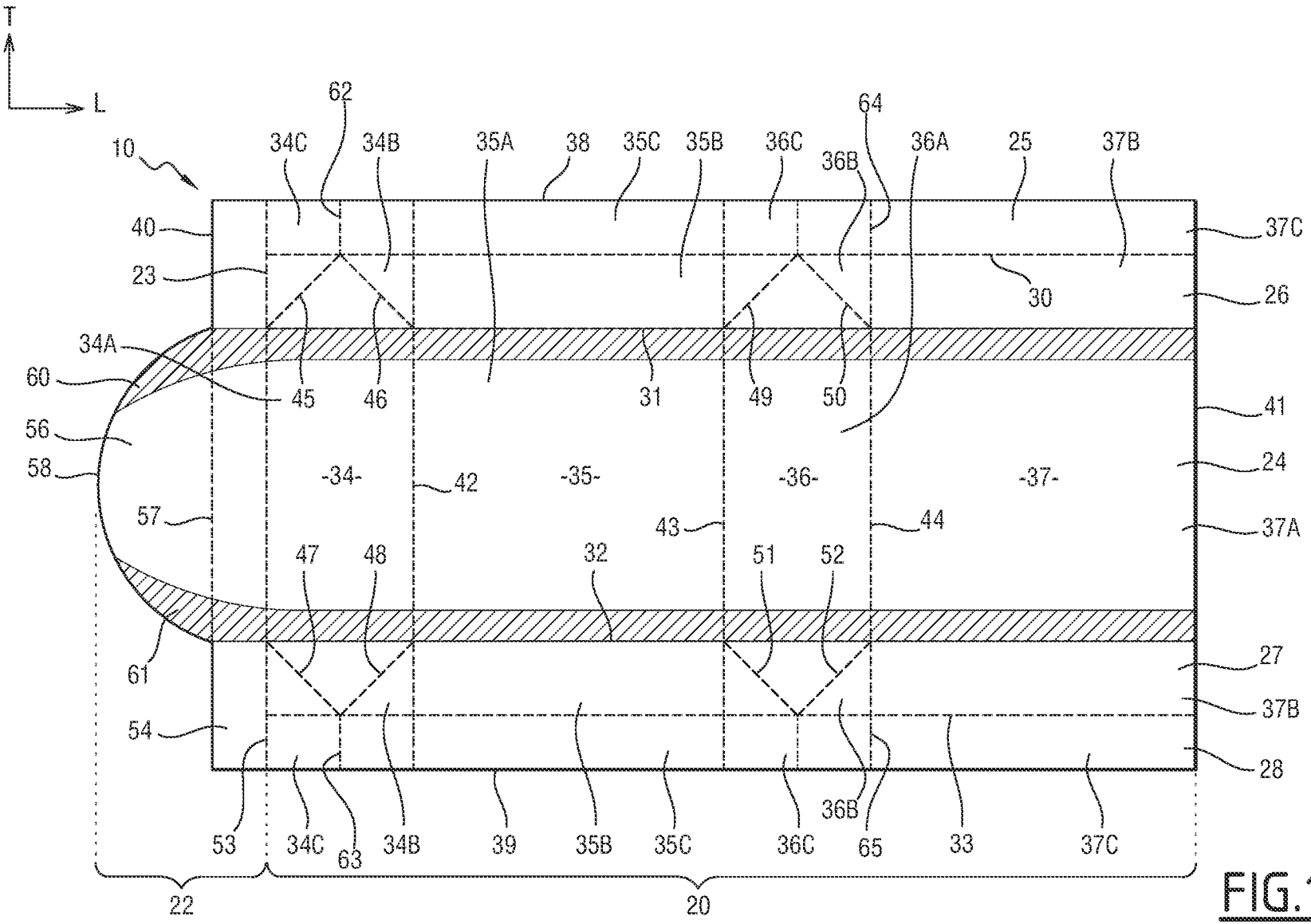
FIG. 13 is a bottom view of a sheet, laid flat, to form a package according to a second variant of the embodiment of FIG. 1.

In the examples shown in FIGS. 1 and 13, the longitudinal panel 34 closest to the end region 22 further comprises two additional weakened portions 45, 46; 47, 48, disposed in each proximal side part 34B of this longitudinal panel 34.

The two additional weakened portions 45, 46; 47, 48 of a proximal side part 34B of this longitudinal panel 34 form with the longitudinal weakened portion 31; 32 separating the proximal side part 34B from the central part 34A a substantially isosceles triangle whose apex is tangent to the longitudinal weakened portion 30; 33 separating the proximal side part 34B from the distal side part 34C.

"Substantially isosceles" means that the angles formed between the base of the triangle and the vertex are substantially equal to within 5%.

Similarly, the longitudinal panel 36 identical to the longitudinal panel 34 closest to the end region 22 further comprises two additional weakened portions 49, 50; 51, 52, arranged in each proximal side part 36B of this longitudinal panel 36.

The two additional weakened portions 49, 50; 51, 52 of a proximal side part 36B of this longitudinal panel 36 form with the longitudinal weakened portion 31; 32 separating the proximal side part 36B from the central part 36A a substantially isosceles triangle whose apex is tangent to the longitudinal weakened portion 30; 33 separating the proximal side part 36B from the distal side part 36C.

The other longitudinal panels 35 and 37 have no additional attenuation.

In one variant, as shown in FIG. 10, the longitudinal panel 35 adjacent to the panel 34 closest to the end region 22 further comprises two additional weakened portions 45, 46; 47, 48, arranged in each proximal side part 35B of this longitudinal panel 35.

The two additional weakened portions 45, 46; 47, 48 of a proximal side part 35B of this longitudinal panel 35 form with the longitudinal weakened portion 31; 32 separating the proximal side part 35B from the central part 35A a substantially isosceles triangle whose apex is oriented toward the closest longitudinal weakened portion 38; 39, and is away from the longitudinal weakened portion 30; 33 separating the proximal side part 35B from the distal side part 35C.

The panel 34 closest to the end region 22 is free of additional weakened portions.

Similarly, the longitudinal panel 37 identical to the longitudinal panel 35 adjacent to the panel 34 closest to the end region 22 further comprises two additional weakened portions 49, 50; 51, 52, arranged in each proximal side part 37B of this longitudinal panel 37.

The two additional weakened portions 49, 50; 51, 52 of a proximal side part 37B of this longitudinal panel 37 form with the longitudinal weakened portion 31; 32 separating the proximal side part 37B from the central part 37A a substantially isosceles triangle whose apex is oriented toward the closest longitudinal weakened portion 38; 39, and is away from the longitudinal weakened portion 30; 33 separating the proximal side part 37B from the distal side part 37C.

The longitudinal panel 36, identical to the longitudinal panel 34 closest to the end region 22, is free of additional weakened portions.

The end region 22 is connected to the main region 20 by a transverse weakened portion 53 extending in the transverse direction T.

The transverse weakened portion 53 opens into the two longitudinal edges 38, 39 of the sheet 10.

The end region 22 comprises a strip 54 extending from the main region 20.

In the examples shown in FIGS. 1 and 10, the longitudinal weakened portions 30, 31, 32, 33 open into the two transverse edges 40, 41 of the sheet 10.

In the example shown in FIG. 13, the longitudinal weakened portions 30, 31, 32, 33 open on the one hand into the transverse edge 41 of the sheet 10 opposite the end region 22 and on the other hand into the strip 54 of the end region 22.

The end region 22 further comprises a tongue 56 extending from the sheet 10 in the longitudinal direction L.

The tongue 56 is secured to the transverse edge 40 of the sheet 10 on the side of the end region 22.

By "integral" it is understood that the tongue 56 is a portion of the same piece as the transverse edge 40 of the sheet 10.

The tongue 56 has an end 57 bonded to the strip 54 of the end region 22 and a free end 58. The free end 58 allows the tongue 56 to be gripped to facilitate the opening of the package 12 once the package 12 is formed.

The tongue 56 extends, for example, from a continuation of the longitudinal weakened portions 31, 32 connecting the proximal side panels 26, 27 to the central panel 24.

Preferably, the sheet 10 has longitudinal tear guide strips 60, 61 along the longitudinal weakened portions 31, 32 connecting the proximal side panels 26, 27 to the central panel 24.

The tear guide strips 60, 61 extend beyond the longitudinal weakened portions 31, 32 into the strip 54 of the end region 22 and at least partially along the contours of the tongue 56.

Each tear guide strip 60, 61 opens at one end into a transverse edge 41 of the sheet 10 opposite the tongue 56 and at another end into the free end 58 of the tongue 56.

The tear guide strips 60, 61 are, for example, in the form of a weakened portion of the sheet 10 in its thickness, in particular by means of a pre-cutting in the middle using blades or laser treatment.

Alternatively or additionally, the tear guide strips 60, 61 are in the form of strips laminated to the sheet 10.

The tear guide strips 60, 61 act both as a guide to prevent the tear from propagating over the area where the tear guide strips 60, 61 are placed, and as a mechanical reinforcement of the sheet to enable it to withstand the pull of the opening. The tear guide strips 60, 61 are preferably along the longitudinal weakened portions 31, 32 connecting the proximal side panels 26, 27 to the central panel 24, these longitudinal weakened portions 31, 32 being intended to form edges of the package 12, 12', which allows a complete opening making accessible at least three sides of the food product P and up to five sides of the food product P, and thus allowing easy access to the food product P by the consumer.

The sheet 10 further comprises four transverse weakened portions 62, 63, 64, 65 each opening at one end into the nearest longitudinal edge 38, 39, and at another end into the apex of one of the four substantially isosceles triangles formed by the additional weakened portions 45, 46; 47, 48; 49, 50; 51, 52.

Alternatively, the transverse weakened portions 62, 63, 64, 65 are formed during the folding of the sheet 10. The sheet 10 before folding is then free of these transverse weakened portions 62, 63, 64, 65.

In the examples shown in FIGS. 1 and 10, the sheet 10 has a transverse weakened portion 66 connecting the longitudinal panel 37 furthest from the end region 22 to a sealing hem 67.

The transverse weakened portion 66 opens into the two longitudinal edges 38, 39 of the sheet 10.

The sealing hem 67 allows the sheet to be doubled in the sealing area in order to strengthen it. The sealing hem 67 prevents the transverse edge 41 of the sheet 10 opposite the end region 22 from being in direct contact with the food product P once the sheet 10 has been folded, and thus avoids the risk of water or fat spreading by capillary action in the sheet if it is not treated all the way through.

In the example shown in FIG. 10, the sheet 10 advantageously also has two primers 68, 69 intended to facilitate the opening of the package 12' by tearing.

For example, one of the two primers 68 is substantially parallel to the transverse direction T and extends into the web 54 between the tear guide strips 60, 61, and the other primer 69 is located in the sealing hem 67 between the tear guide strips 60, 61 and forms two arcs of a circle each extending from the vicinity of a tear guide strip 60; 61 and opening into the nearest transverse edge 41 of the sheet 10.

The central parts 34A, 35A, 36A, 37A of the four longitudinal panels 34, 35, 36, 37 are intended to form faces 100, 102, 104, 106 of the package 12.

The faces 100, 102, 104, 106 typically comprise a front face 100 opposite a rear face 102 receiving the tongue 56, and two transverse side faces 104, 106.

Advantageously, the front 100 and rear 102 faces are square in shape.

Figure 7:
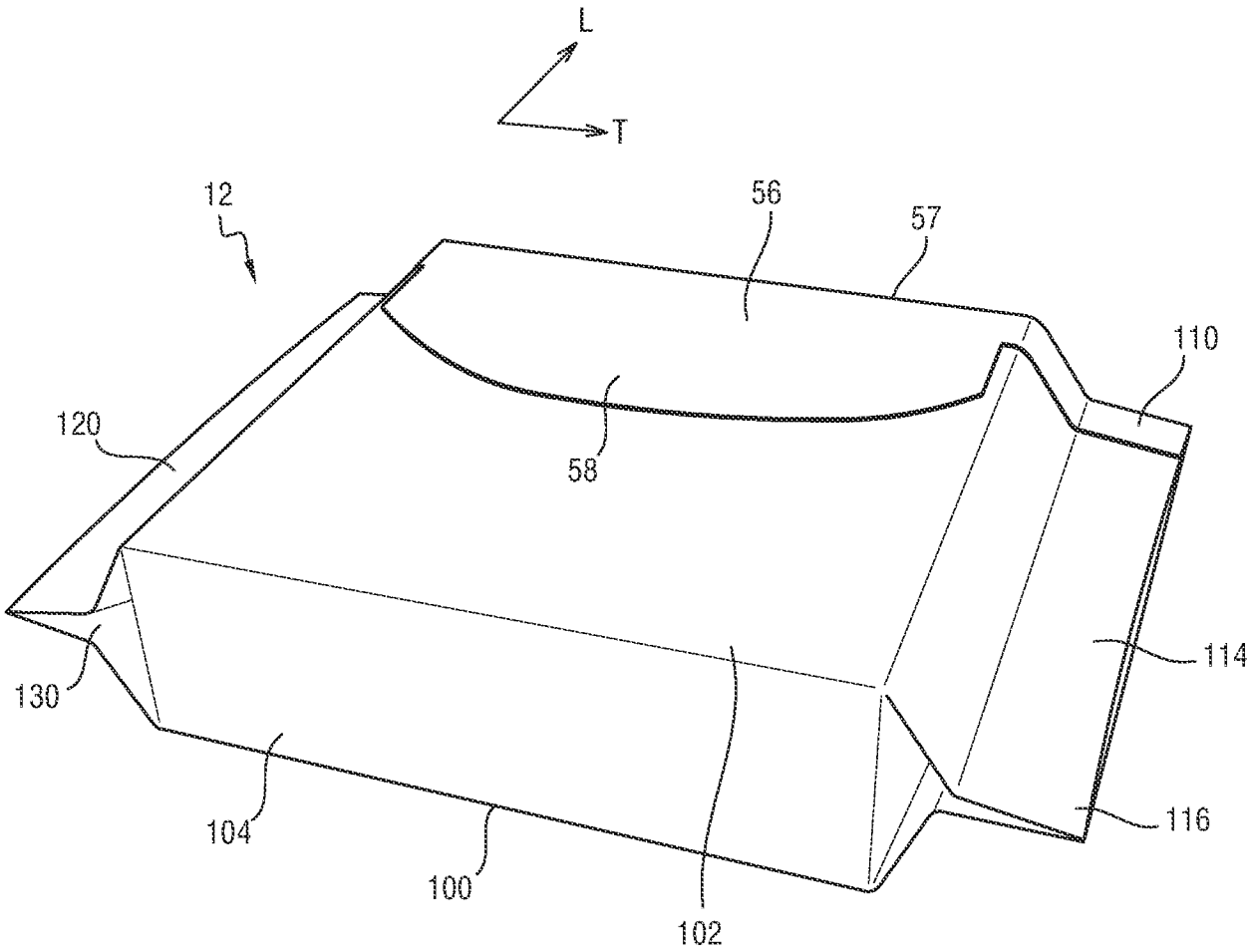

According to the first preferred embodiment shown in FIG. 7, the side faces 104, 106 are rectangular in shape rather than square so that the resulting package 12 is a rectangular parallelepiped.

In the example shown in FIG. 11, the side faces 104, 106 are also square so that the resulting package 12' is a cube.

In another variant, the front 100 and rear 102 faces are non-square rectangular and the side faces 104, 106 are non-square rectangular so that the resulting package 12 is a rectangular parallelepiped.

It is understood that, depending on the variant, the cube-shaped package may not have a sealing hem and may have a peelable transverse joint, and that the parallelepiped shape may have a hem and primers and may have a tearable transverse joint.

"Peelable" means a watertight fastening, by gluing or sealing, which allows the two parts thus fastened to be separated manually during normal use of the packaging without tearing them.

Figure 2:
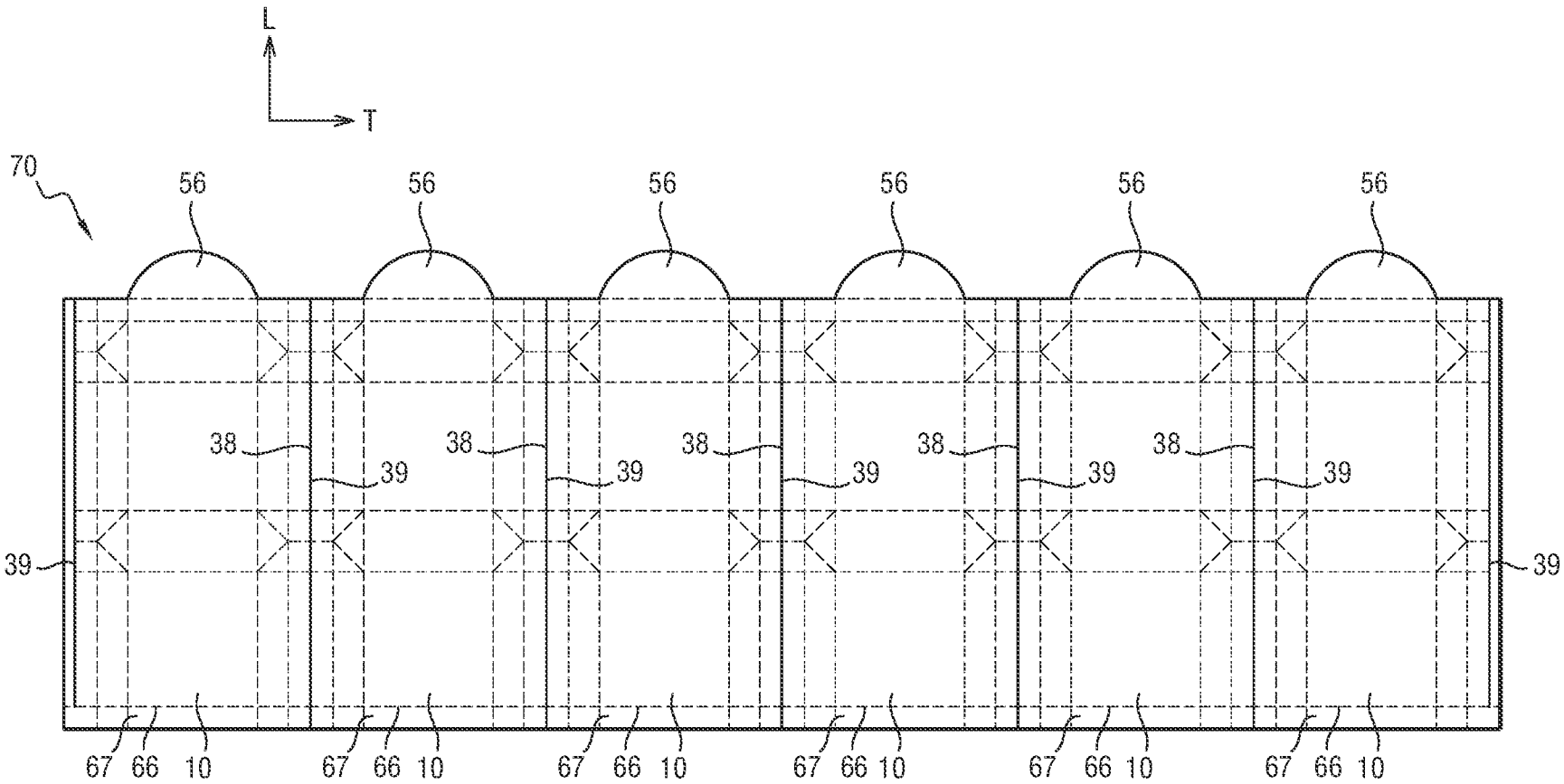
FIG. 2 is a bottom view of a blank, laid flat, formed of a plurality of sheets according to the invention.

A blank 70 comprising a plurality of sheets 10 is shown in FIG. 2.

The sheets 10 are joined together at the longitudinal edge 38, 39.

The package 12; 12' is preferably intended to comprise a food product P, in particular an individual portion of food product P, as non-limiting examples:

- a portion of dairy products such as but not limited to cheese, products comprising a cheese base and/or a dairy base,
- a portion of dairy alternatives,
- a portion of composite products comprising at least one dairy base and at least one other non-dairy base, for example a cereal and/or legume base,
- a portion of plant-based food products,
- a portion of confectionery or chocolate products,
- a portion of culinary aids such as bouillon cubes or derivatives.

In a particular embodiment, the package 12; 12' contains a food product P.

A method for manufacturing and filling at least one package 12; 12 will now be described.

Figure 3:
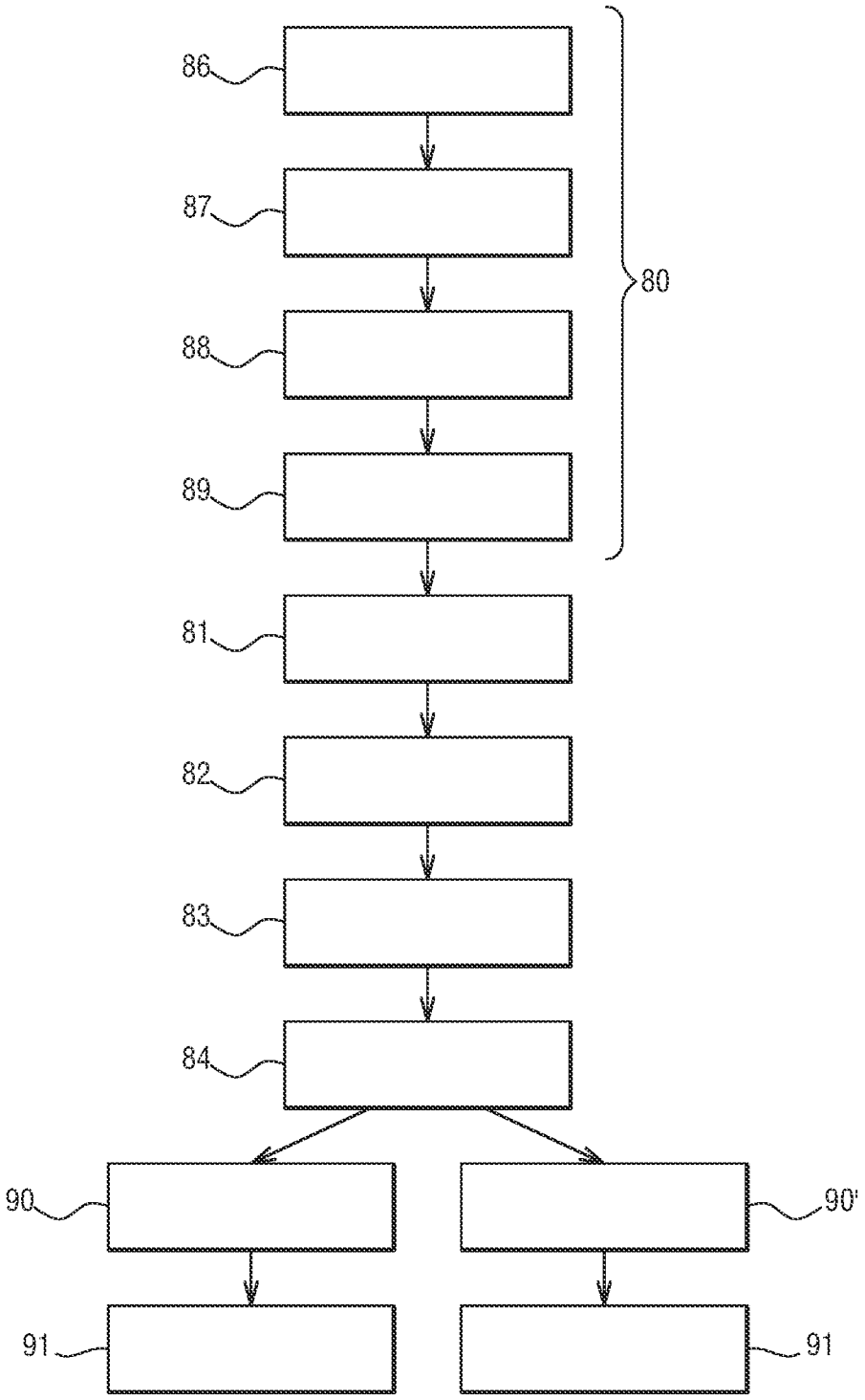
FIG. 3 is a flow chart illustrating the main steps of a package forming and filling method according to the invention.

The method, whose flowchart is shown in FIG. 3, comprises at least:

- a step 80 of providing the blank 70 with a plurality of sheets 10, each sheet 10 having weakened portions 30, 31, 32, 33, 42, 43, 44, 53, 45, 46, 47, 48, 49, 50, 51, 52, 53, 62, 63, 64, 65, 66 comprising transverse weakened portions 42, 43, 44, 53, 66, and a tongue 56 secured to a transverse edge 40 of the sheet 10,
- a step 81 of folding the blank 70 along the transverse weakened portions 42, 43, 44, 53, 66 of each sheet 10 to form a tube 122 of rectangular cross-section and transversely sealing the blank 70 to itself to form a peelable or tearable transverse joint 110, the tongue 56 of each sheet 10 projecting longitudinally from the transverse joint 110, and, for each sheet 10,
- a step 82 of longitudinally sealing each sheet 10 to form a longitudinal base joint 114 thereby defining an inner cavity 122 suitable for containing a food product P,
- a step 83 of filling the inner cavity 122 with food product, and
- a step 84 of closing the package 12;12' by longitudinally sealing the sheet 10 to itself to form a longitudinal top joint 120 spaced from the longitudinal base joint 114, the transverse joint 110 extending from one longitudinal joint 114, 120 to the other, the longitudinal top joint 120 of the sheet 10 forming the longitudinal base joint 114 of the next sheet 10.

In the delivery step 80, the blank 70 with a plurality of sheets 10 is advantageously in the form of a roll.

In a sub-step 86, the blank 70 is unwound, for example, by techniques known in food product packaging.

The following steps are described for each sheet 10 of the blank 70.

In a sub-step 87, the tear guide strips 60, 61 are formed.

The tear guide strips 60, 61 are, for example, in the form of a weakened portion of the sheet 10 in its thickness, in particular by means of a pre-cutting in the middle using blades or laser treatment.

Alternatively or additionally, the tear guide strips 60, 61 are in the form of strips laminated to the sheet 10.

In a sub-step 88, before or after the tear guide strips 60, 61 are made, the longitudinal 30, 31, 32, 33, transverse 42, 43, 44, 53, 62, 63, 64, 65, 66, and additional 45, 46, 47, 48, 49, 50, 51, 52, 53 weakened portions are formed.

The longitudinal 30, 31, 32, 33, transverse 42, 43, 44, 53, 62, 63, 64, 65, 66, and additional 45, 46, 47, 48, 49, 50, 51, 52, 53 weakened portions are, for example, produced by crushing the sheet 10.

The crushing is carried out by a protruding metal tool pressing the sheet 10 arranged in a counterpart in the form of a groove receiving the metal tool.

Crushing is particularly suitable for materials such as paper and cardboard, but also for some plastics.

Alternatively or additionally, the longitudinal 30, 31, 32, 33, transverse 42, 43, 44, 53, 62, 63, 64, 65 and additional 45, 46, 47, 48, 49, 50, 51, 52, 53 weakened portions are, for example, achieved by removing a part of the sheet 10 in its thickness, via a pre-cutting of the middle of the sheet by means of knives or by laser treatment.

In this case, the folding weakened portion is partly merged with the tear guide strips 60, 61 in the form of a weakened portion of the sheet 10, with the opening taking place along the folding weakened portions.

By making such weakened portions, the rigidity of the sheet can be reduced along precise lines to allow it to be folded when shaping the sheet 10 before filling and to finalise its shaping after filling.

In a sub-step 89, in order to form an opening system, part of the sheet 10 is for example cut off at one of the longitudinal edges 38, 39 of the sheet 10 to create the tongue 56.

Alternatively, the tongue 56 is made by a combination of cutting and folding.

For example, two straight cuts are made in the sheet perpendicular to the edge where the tongue is made, and the sheet is folded back on itself at 45° outside each cut to form a point. The part of the sheet folded to form the flap is sealed and glued to prevent the flap from unfolding.

This sub-step 89 may be performed before, during or after sub-step 87 of forming the tear guide strips 60, 61 and sub-step 88 of forming the longitudinal 30, 31, 32, 33, transverse 42, 43, 44, 53, 62, 63, 64, 65 and additional 45, 46, 47, 48, 49, 50, 51, 52, 53 weakened portions. The tongue 56 is formed by a simple cut in the sheet 10, or by a combination of one or more cuts and one or more folds.

In the particular case of the embodiment shown in FIG. 10, the primers 68, 69 are additionally formed by a simple cut in the sheet 10, or by a "half-flesh" cut.

The primers 68, 69 can be formed during the sub-step 88 of forming the longitudinal 30, 31, 32, 33, transverse 42, 43, 44, 53, 62, 63, 64, 65 and additional 45, 46, 47, 48, 49, 50, 51, 52, 53 weakened portions or during the sub-step 89 of making the tongue 56.

In step 81 of folding the blank 70, each sheet 10 is folded on itself along the transverse weakened portions 42, 43, 44 to form a front face 100, a rear face 102, and two transverse side faces 104, 106 with an angle of 90° between two consecutive faces 100, 102, 104, 106.

Figure 5:
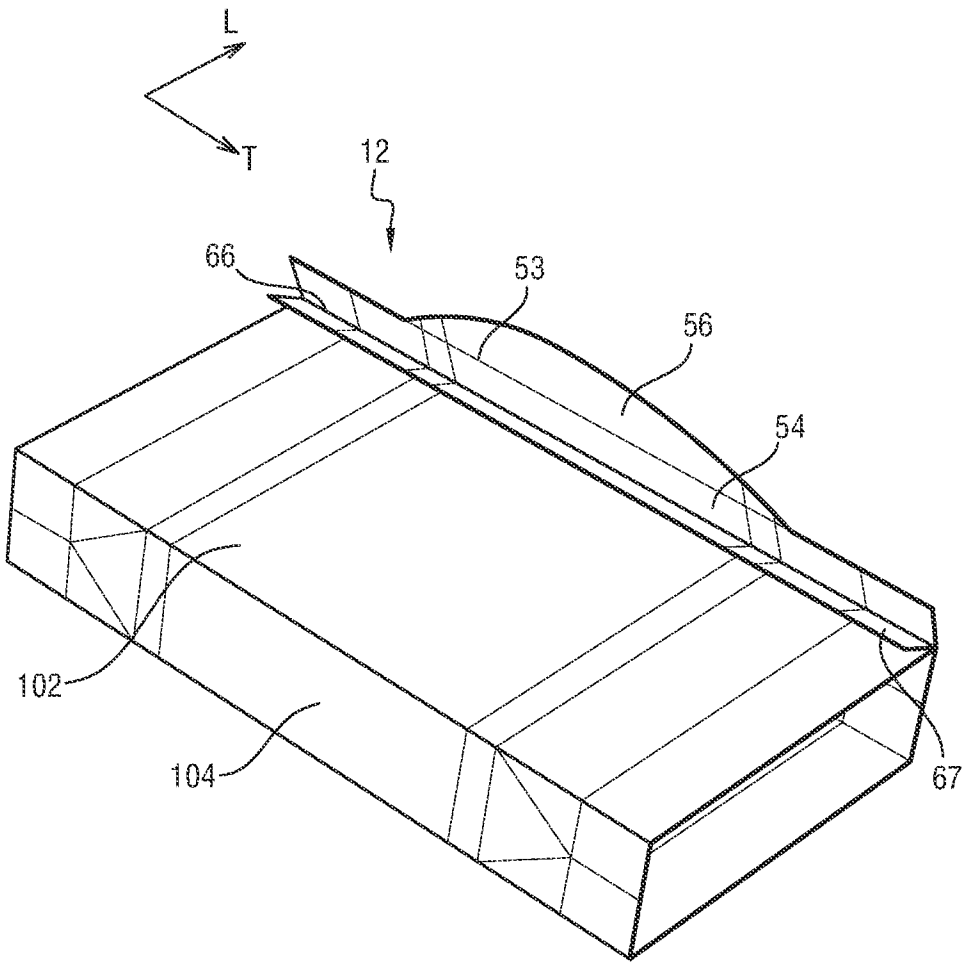
FIGS. 5 to 8 are perspective views of a package formed with the sheet of FIG. 1, at different stages of the package forming and filling method.

In the examples shown in FIGS. 1 and 10, the sealing hem 67 is folded as shown in FIG. 5 along the transverse weakened portion 66 connecting the hem 67 to the longitudinal panel 37 furthest from the end region 22, towards the outside of the package 12; 12' so that folding the sheet 10 onto itself along the transverse weakened portions 42, 43, 44 brings the strip 54 and the sealing hem 67 opposite each other.

The tongue 56 and the strip 54 are folded over the rear side 102 along the transverse weakened portion 53.

Figure 4:
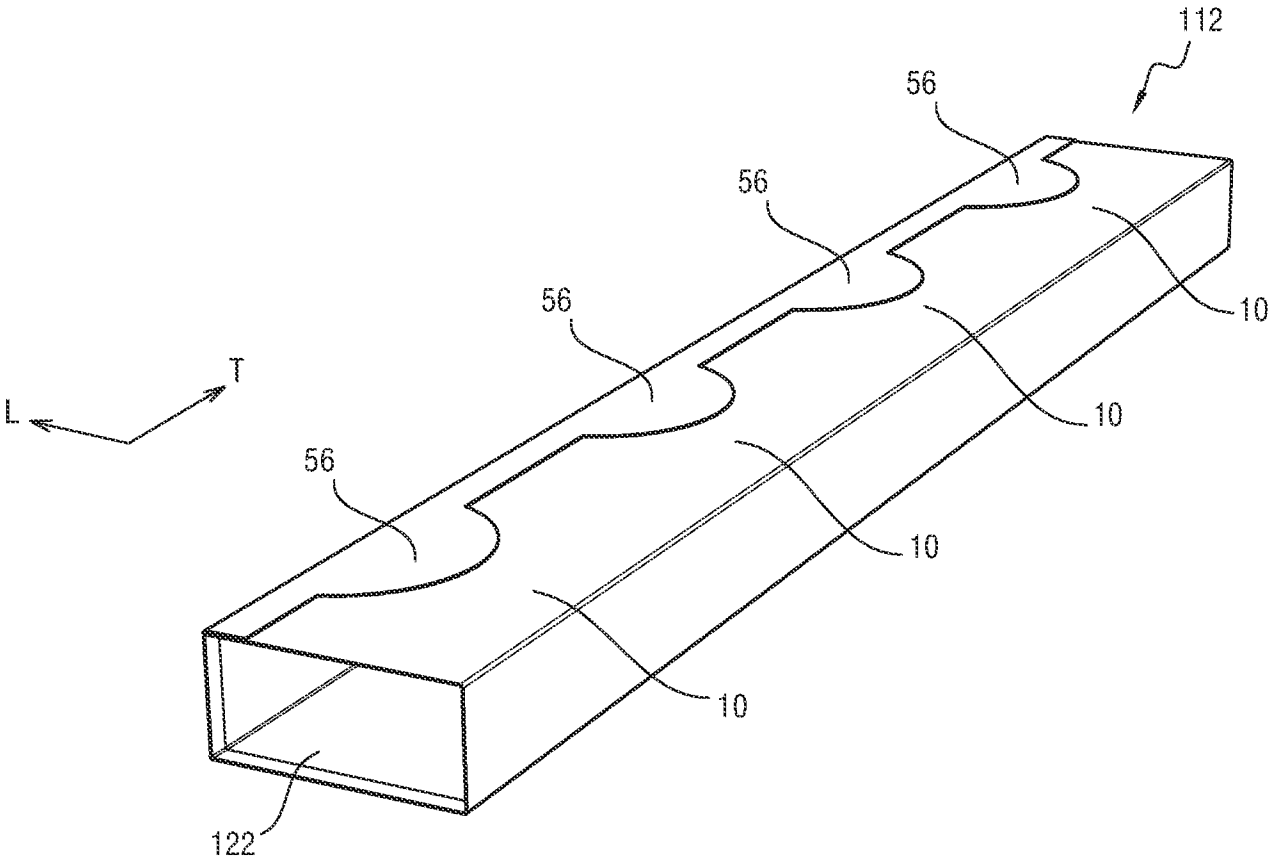
FIG. 4 is a perspective view of a tube formed with the blank of FIG. 2 with the package closed.

The blank 70 with a plurality of sheets 10 folded in this way forms a tube 112 of rectangular cross-section shown in FIG. 4.

The tongue 56 projects longitudinally from the transverse joint 110.

Rectangular cross-section means rectangular or square.

To form the tube 112 of a plurality of sheets 10, a gooseneck forming equipment is used, for example, the outlet of which has a rectangular cross-section and is extended by a pipe with the same cross-section as the outlet cross-section of the cheese equipment.

Through the combined action of the forming equipment and the transverse weakened portions 42, 43, 44, 53, a tube 112 with a rectangular cross section is obtained.

The equipment used to produce the packaging 12; 12' advantageously comprises counterparts that allow the geometry of the tube 112 to be maintained from the outside, by pressing it against the pipe.

The counterparts are typically simple plates fitted around the tube 112, or drive rollers.

In the folding step 81 of the blank 70 with a plurality of sheets 10 shown in FIGS. 1 and 10, for each sheet 10, the strip 54 is sealed to the sealing hem 67 as packages 12 are produced by the method.

The seal is a "flesh-flesh" seal.

Sealing is achieved, for example, by heated or ultrasonic rollers applied to the tube 112, or by heated or ultrasonic bars applied to the tube 112.

The sealed strip 54 forms a transverse joint 110 of the package 12; 12'.

The transverse joint 110 is peelable or tearable.

Figure 9:
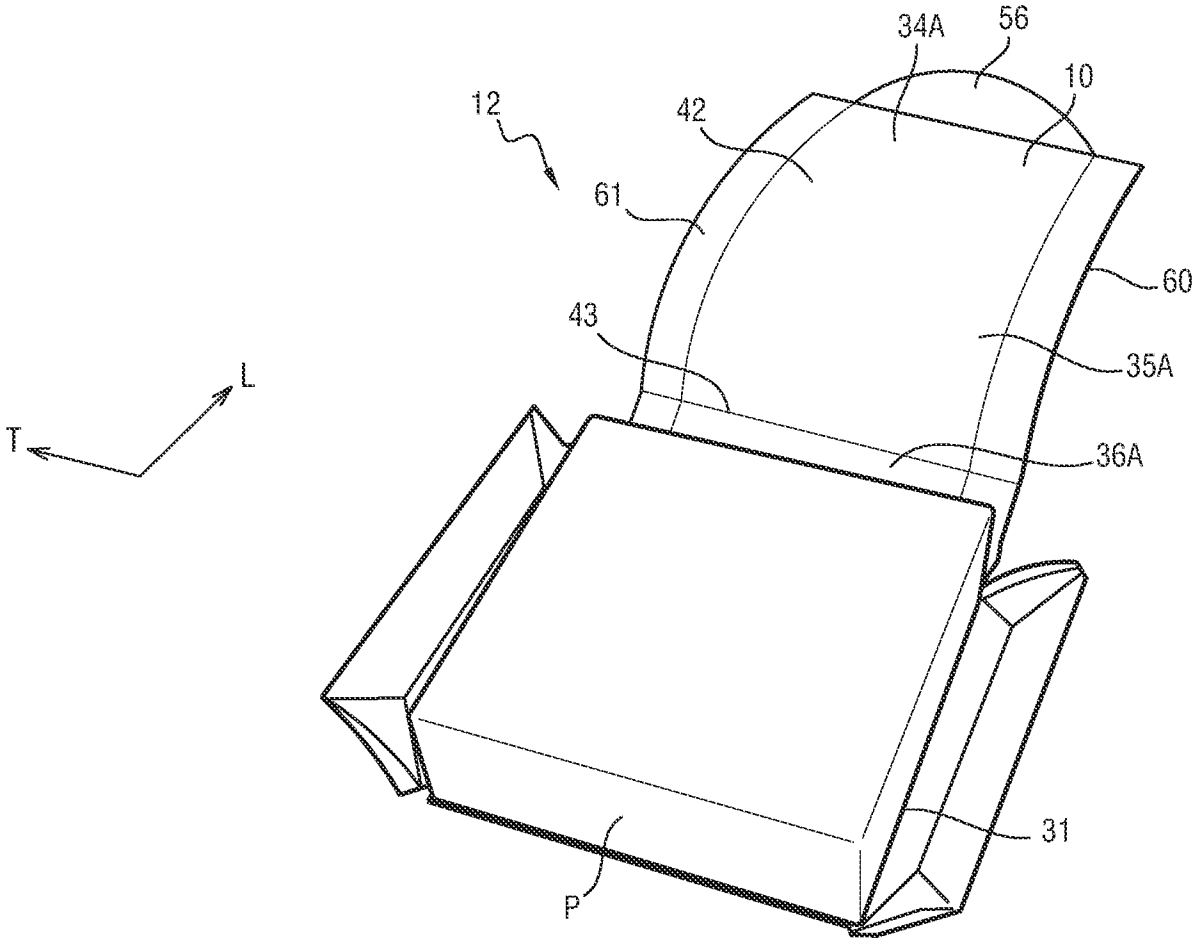
FIG. 9 is a similar view to FIG. 8, with the package open.

The sealing hem 67 prevents the transverse edge 41 of the sheet 10 opposite the end region 22 from being in direct contact with the food product P when the sheet 10 is folded. This geometry is particularly suitable for materials that cannot be brought into direct contact with the product, such as paper or cardboard materials. When the transverse joint 110 is peelable, as shown in FIG. 9, this sealing must be carried out with a precise configuration.

A tearable transverse joint 110 as shown in FIG. 12 is obtained by means of the primers 68, 69.

In the particular case of the example shown in FIG. 13 without a sealing hem, for each sheet 10, the tongue 56 and the strip 54 are folded over the rear face 102 along the transverse weakened portion 53 as packages 12' are produced by the method.

The strip 54 is sealed to the rear face 102.

This seal is of the "leather-flesh" type, giving a peelable type of seal so as to obtain a really easy opening at the end of the journey.

Sealing is achieved, for example, by heated or ultrasonic rollers applied to the tube 112, or by heated or ultrasonic bars applied to the tube 112.

In this example, the thickness of the sheet 10 should not be sensitive to the food product P contained in the package 12. Indeed, on the transverse edge 41 of the sheet 10 opposite the end region 22, all of the materials making up the sheet 10 are exposed and therefore exposed to direct contact with the food product P. To remedy this, this example requires either the use of a naturally resistant material, or the covering of this zone where the food product P is exposed with a sealing and possibly water and gas barrier layer as defined above.

This is particularly important for materials that are sensitive to water and grease, such as paper and cardboard.

Figure 6:
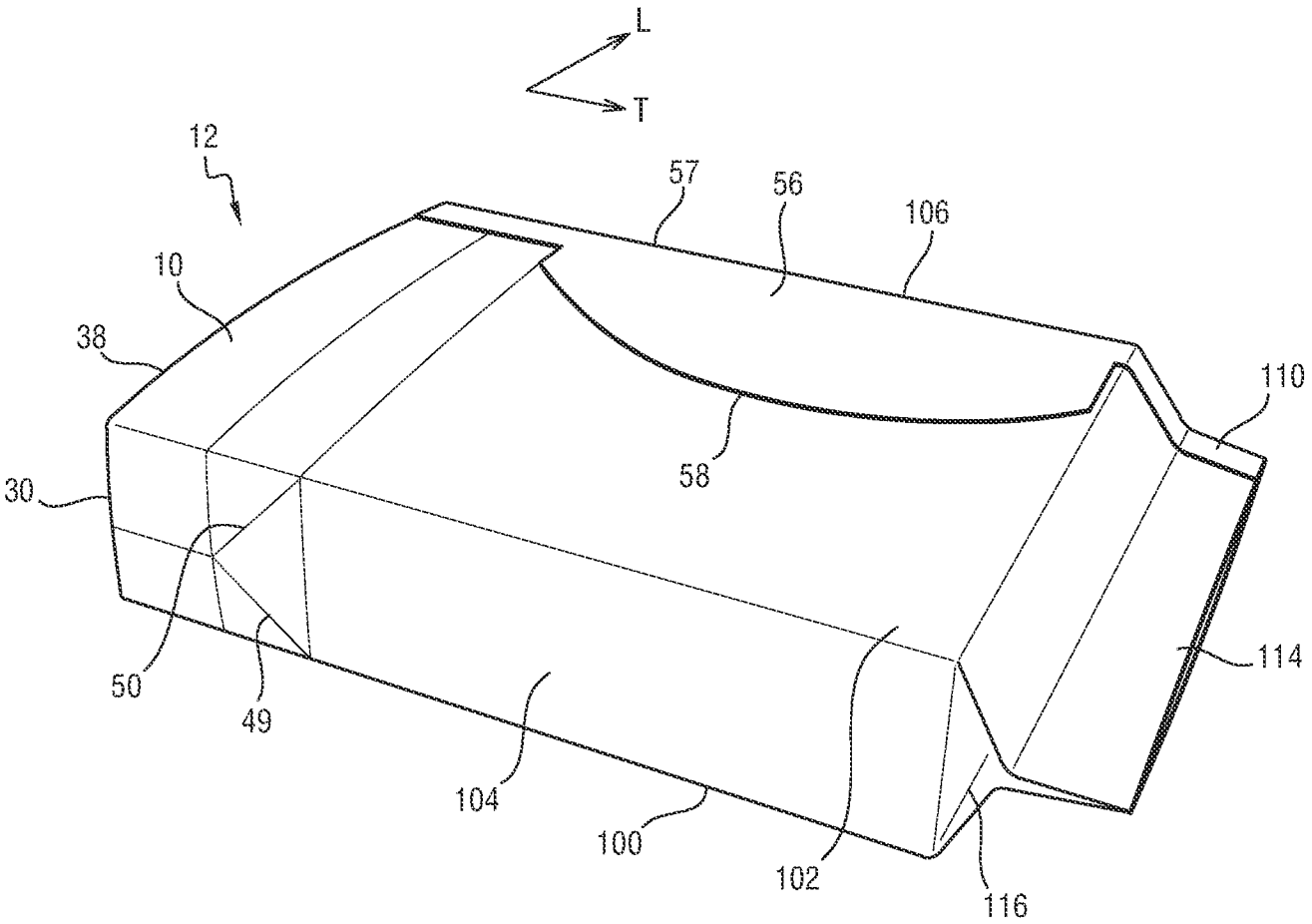

In step 82 of longitudinally sealing the sheet 10, the sheet 10 is longitudinally sealed in the vicinity of one of the two longitudinal edges 39 to form a longitudinal base joint 114 as shown in FIG. 6.

The longitudinal sealing in the vicinity of said longitudinal edge 39 results in the formation of a gusset 116, as shown in FIG. 6, by a fold along the four additional weakened portions 47, 48, 51, 52 located on the side of said longitudinal edge 39 facing the interior of the package 12, a fold along the longitudinal weakened portion 32 connecting the central panel 24 and the proximal side panel 27, a fold along the longitudinal weakened portion 33 connecting the proximal side panel 27 and the distal side panel 28, and a fold along the two transverse weakened portions 63, 65 each opening out at one end in the apex of one of the two substantially isosceles triangles formed by the additional weakened portions 47, 48, 51, 52 located on the side of said longitudinal edge 39.

Preferably, the folds to form the gussets 116 are made simultaneously.

In one variant, the longitudinal sealing in the vicinity of said longitudinal edge 39 results in the formation of two points 116' instead of gussets, projecting longitudinally outward from the longitudinal joint 114, as shown in FIG. 11, by a fold along the four additional weakened portions 47, 48, 51, 52 located on the side of said longitudinal edge 39 facing the exterior of the package 12, a fold along the longitudinal weakened portion 32 connecting the central panel 24 and the proximal side panel 27, a fold along the longitudinal weakened portion 33 connecting the proximal side panel 27 and the distal side panel 28, and a fold along the two transverse weakened portions 63, 65 each opening out at one end in the apex of one of the two substantially isosceles triangles formed by the additional weakened portions 47, 48, 51, 52 located on the side of said longitudinal edge 39.

Preferably, the folds to form the points 116' are made simultaneously.

The longitudinal seal is typically made by two jaws arranged opposite each other on either side of the sheet 10.

The sealing time is preferably between 0.2 seconds and 0.5 seconds. Sealing is done as quickly as possible so as not to impact the production rate.

The longitudinal base joint 114 does not need to be peeled to open the package 12 once formed, and can be soiled, so the longitudinal seal is advantageously made strong to ensure a good seal.

Preferably, the longitudinal seal is an ultrasonic seal, which is particularly suitable in the present method.

Ultrasonic sealing allows sealing even when a sealing area is soiled or through a food product P contained in the package 12.

In order to ensure a good longitudinal fold, the folding and sealing is preferably carried out in the vicinity of the downstream end of the forming equipment for forming the tube 112, the forming equipment being used in this situation as a counterpart to the folding.

The downstream end is understood to be the end downstream of the forming operation.

The longitudinal base joint 114 of a sheet 10 is typically made at the same time as a longitudinal top joint 120 closing the previous sheet 10.

The sheet 10 folded onto itself and sealed longitudinally along a longitudinal base joint 114 defines an inner cavity 122 suitable for containing a food product P.

In filling step 83, once the longitudinal base joint 114 of a sheet 10 has been formed, the inner cavity 122 of the sheet 10 is filled with food product P.

To this end, the sheet 10 is moved past the end of the forming equipment.

A pipe inside the forming equipment allows the food product P to be dosed into the inner cavity 122.

In order to be able to carry out the filling, the forming equipment has a vertical geometry, and its upstream end is located above its downstream end.

The upstream end is understood to be the end upstream of the forming operation.

The dosing is preferably carried out at temperatures between 20° C. and 90° C., preferably between 30° C. and 80° C.

The food product P during dosing is in a liquid or viscous state so as to occupy the entire inner cavity 122.

Preferably, the tube is lowered at the time of dosing and raised at the end of dosing so that the level of food product P discharged is as close as possible to the maximum level reached after dosing and to avoid the risk of splashing on the tube 112 and the forming equipment.

The dosage of food product P must be accurate in volume.

Advantageously, the tube is lowered in the vicinity of the just-sealed longitudinal base joint 114 and is raised as dosing proceeds to remain always slightly above the level of food product P in the inner cavity 122, in order to avoid trapping air bubbles in the package 12 once formed.

In the closing step 84, once the inner cavity 122 of the sheet 10 is filled with food product P, the longitudinal top joint 120 closing the package 12 is formed by longitudinal folding and sealing in the vicinity of the longitudinal edge 38 opposite the already formed longitudinal base joint 114.

In the same manner as to form the longitudinal base joint 114 before filling the inner cavity 122, the longitudinal sealing in the vicinity of the longitudinal edge 38 results in the formation of a gusset 130, as shown in FIG. 7, by a fold along the four additional weakened portions 45, 46, 49, 50 located on the side of said longitudinal edge 38, a fold along the longitudinal weakened portion 31 connecting the central panel 24 and the proximal side panel 26, a fold along the longitudinal weakened portion 30 connecting the proximal side panel 26 and the distal side panel 25, and a fold along the two transverse weakened portions 62, 64 each opening out at one end in the apex of one of the two substantially isosceles triangles formed by the additional weakened portions 45, 46, 49, 50 located on the side of said longitudinal edge 38.

Preferably, the folds to form the gussets 130 are made simultaneously.

In one variant of the gussets 130, the longitudinal sealing in the vicinity of said longitudinal edge 38 results in the formation of two points 130' projecting longitudinally outward from the longitudinal joint 120, as shown in FIG. 11, by a fold along the four additional weakened portions 45, 46, 49, 50 located on the side of said longitudinal edge 38 facing the exterior of the package 12, a fold along the longitudinal weakened portion 31 connecting the central panel 24 and the proximal side panel 26, a fold along the longitudinal weakened portion 30 connecting the proximal side panel 26 and the distal side panel 25.

Preferably, the folds to form the points 130' are made simultaneously.

The longitudinal seal closing the sheet 10 is advantageously made just above the level of the food product P so as to leave little or no headspace.

The longitudinal seal closing the sheet 10 is, for example, made by two jaws arranged opposite each other on either side of the sheet 10 at an elevated temperature for a sealing time of between 0.2 seconds and 0.5 seconds.

Preferably, the longitudinal seal closing the foil 10 is an ultrasonic seal, which allows the food product P to be sealed through and thus results in a headspace-free package 12.

The longitudinal top joint 120 is typically made at the same time as the longitudinal base joint 114 of the next sheet 10 before filling.

The process includes, for example, an additional step 90 of separating two successive packages 12;12' by cutting. The packaging 12, 12' is cut longitudinally in the vicinity of the longitudinal top joint 120 closing the sheet 10 and separated from the tube 112 at the same time as or immediately after the formation of the longitudinal top joint 120, without any intermediate step.

The package 12 is typically cut longitudinally in the vicinity of the longitudinal top joint 120 with a knife.

As a result of the steps described above, thanks to the rigidity of the sheet 10 and the weakened portions carried out to obtain a fold, a package 12 is obtained, shown in FIG. 7, which takes the form of a partially parallelepipedic bag with two gussets 116, 130 corresponding to the two longitudinal seals.

The inner cavity 122 is sealed by longitudinal and transverse seals.

In one embodiment, a package 12', shown in FIG. 11, is obtained which takes the form of a partially cubic bag with two points 116', 130' per longitudinal joint 114, 120 projecting longitudinally outwards corresponding to the two longitudinal seals.

It is understood that a partially parallelepipedic package may alternatively have two points per longitudinal joint and that a partially cubic package may have two gussets.

The package 12, 12' typically forms a single portion of food product P.

Figure 8:
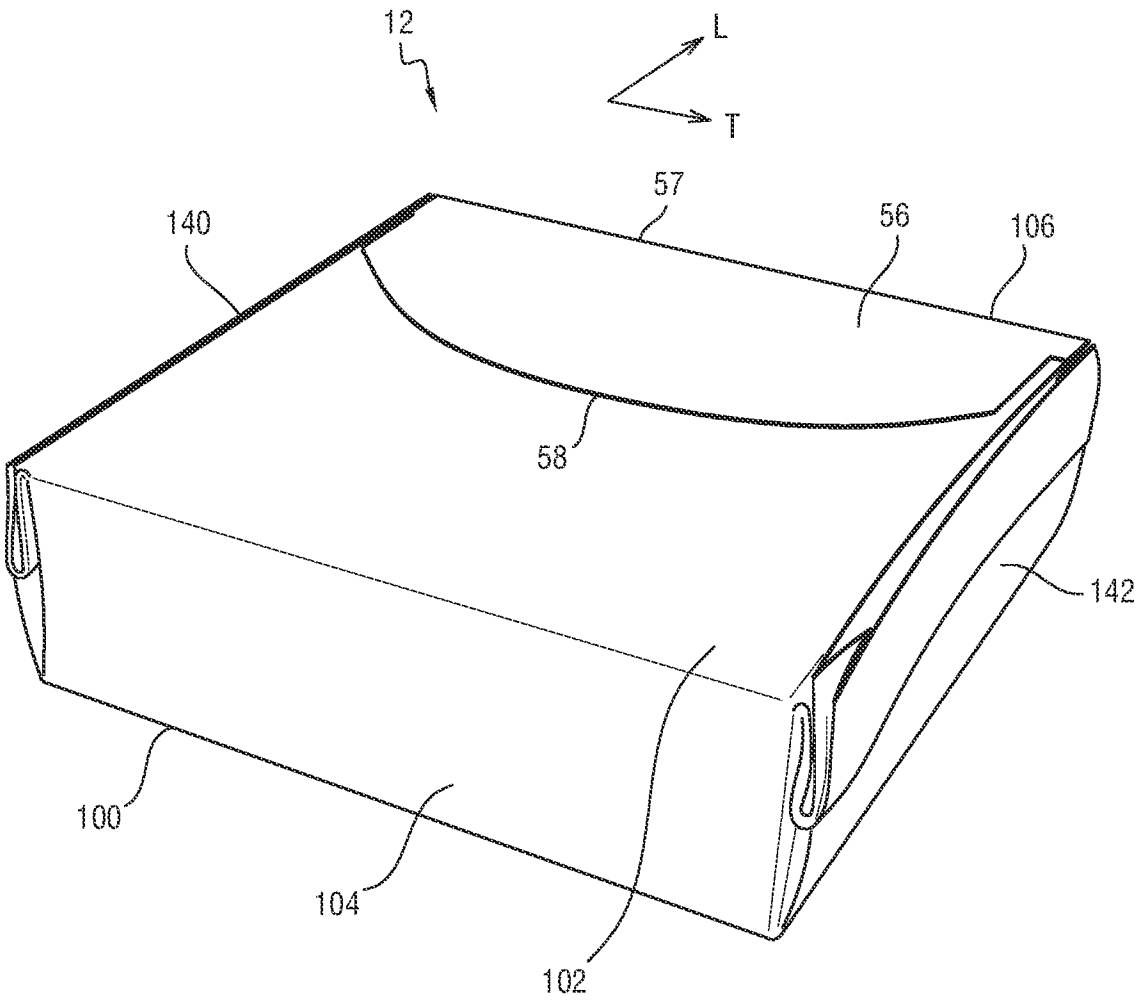

Optionally, a last step 91 of shaping the package 12; 12' of FIG. 7 consists in folding the two longitudinal joints 114, 120 against the package 12; 12' in order to obtain a parallelepiped shape, as shown in FIG. 8, or a cubic shape.

The package 12 of FIG. 8 comprises a front side 100, a rear side 102, two transverse side faces 104, 106 and two longitudinal side faces 140, 142.

Typically, the package 12 is placed in a former comprising an inlet and an outlet, the inlet having a funnel shape and the outlet having a cross-section corresponding to that of the desired package 12.

Slots are provided in the inlet of the forming machine for the insertion of the gussets 116, 130, the slots then sloping towards the front 100 or rear 102 of the package 12 to fold the gussets 116, 130 onto the two longitudinal side faces 140, 142 of the package 12.

Depending on the material used, an adhesive or heat is used to reactivate a heat seal varnish previously applied to the material in order to fix the gussets 116, 130 to the two longitudinal side faces 140, 142 of the package 12.

In the embodiment in which points 116', 130' are formed instead of gussets 116, 130 during sealing, the optional last shaping step comprises, for example, the following steps: the longitudinal joints 114, 120 are folded flat onto the longitudinal side faces 140, 142 of the package 12', and then the points 116', 130' are folded over onto the longitudinal side faces 140, 142 of the package 12, or onto the front side 100 or the rear side 102 of the package 12.

The sealing points 116', 130' are folded over, for example, by means of a forming machine separate from the forming equipment used for forming the tube 112, during the advancement of the package 12', or by means of a mobile mechanical system.

It should be noted that the food product P is always in a liquid or viscous state during this stage.

The last optional forming step 91 allows improved storage of the packages 12; 12' by reducing the volume occupied by the packages 12; 12' and participates in the shaping of the food product P in the package 12, 12' by reinforcing the longitudinal lateral faces 140, 142.

Advantageously, the package 12;12' is itself packaged in a secondary package (not shown) which also acts as a mould to solidify the food product P in the package 12;12' in the desired shape.

If required, such a secondary package may be provided with compartments for receiving each package 12;12' individually while the food product P solidifies and until the food product P is consumed by the consumer.

Optionally, in order to obtain the most perfect geometry possible, the package 12; 12' is for example inserted into a mould, or a forming machine, holding it in the desired geometry while the food product P gels and takes on its final texture.

This step of setting the texture of the product P is advantageously accelerated by a rapid cooling of the product P in its packaging 12; 12' held in shape.

To open the package 12, a consumer grasps the free end 58 of the tongue 56 and pulls in a single movement along the longitudinal weakened portions 31, 32 connecting the proximal side panels 26, 27 to the central panel 24 so that the food product P is accessible as shown in FIG. 9.

When present, the tear guide strips 60, 61 facilitate guiding the opening so that the food product P is accessible on at least three sides of the package 12, 12', preferably five sides when the package 12, 12' is opened.

In a particular embodiment of the package 12, 12', the tear guide strips 60, 61 facilitate guiding the opening so that the food product P is accessible on exactly three sides of the package 12, 12'.

The three-sided access to the product makes it easy for the consumer to grip and eat, for example by taking it out of the package in one piece and biting into it.

After tearing, the consumer can, if he wishes, simply release the two longitudinal side faces 140, 142 and thus have very wide access to the product, for example to place it on bread without touching it with his fingers.

This reduces product loss and makes the product easy to consume.

The primers 68, 69 contribute to the opening of the package 12' by weakening the sheet 10, which is thus easier to tear.

Opening the packaging 12 is therefore very simple.

Figure 14:
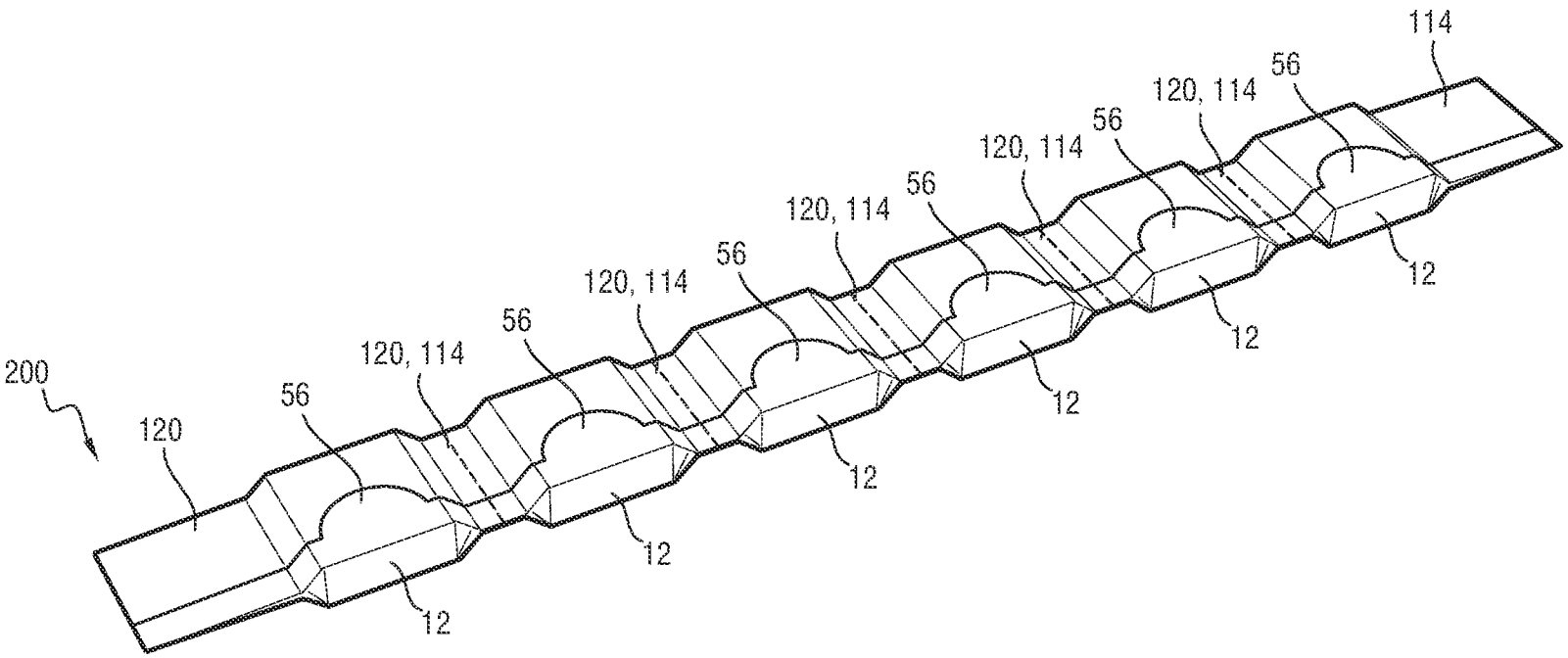
FIG. 14 is a perspective view of a string of packages formed with the blank of FIG. 2 according to a variant of a method for forming and filling the package according to the invention.

According to one embodiment of the method for manufacturing and filling the package 12, a plurality of packages 12 are presented in the form of a string 200 where the packages 12 are secured to each other, with the longitudinal base joint 114 of one package 12 being merged with the longitudinal top joint 120 of the adjacent package 12, as shown in FIG. 14.

For this purpose, the shaping of the tube 112 and the filling method are identical to those described above.

The method comprises, for example, a further step 90' of forming a longitudinal pre-cut between two successive packages 12;12'.

The pre-cut is formed longitudinally in the vicinity of the longitudinal top joint 120 closing the sheet 10 and separated from the tube 112 at the same time as or immediately after the formation of the longitudinal top joint 120, without any intermediate step.

The step 91 of folding back the gussets 130 or the points 116 only concerns the end packages 12 of the string 200 in this embodiment.

The knife is replaced by a serrated blade forming a longitudinal pre-cut between two successive packages 12.

This means that the packages 12 are not completely cut off from each other and the packages 12 remain secured to each other.

The individual packages 12 can be easily separated from the string thanks to the pre-cutting by the serrated blade.

The packages 12 on the string are then optionally overpacked in a secondary package.

The secondary package is, for example, a sheet made of cardboard enclosing a string of packages consisting of an even number of packages stacked in pairs, the sheet of the secondary package being sealed to itself along a longitudinal joint.

Alternatively, the individual packages are glued together with a weak adhesive. The front side of a single package is glued to the back side of the adjacent package

The invention claimed is:

1. A packaging for a food product formed by a sheet resulting from a blank with a plurality of sheets secured to one another by a longitudinal edge, each sheet being intended to form a package, each sheet of the blank having weakened portions comprising transverse weakened portions, and a tongue secured to a transverse edge of the sheet, each sheet of the blank being folded along the transverse weakened portions to form a tube of rectangular cross-section and sealed to itself along a peelable or tearable transverse joint, with the tongue projecting longitudinally from the transverse joint, wherein the sheet further has a transverse weakened portion along which the sheet is folded towards the outside of the package to form a sealing hem under the transverse joint, the tongue has an end bonded to a strip and a free end, the tongue and the strip are folded over the rear side of the packaging along a transverse weakened portion and the strip is sealed to the sealing hem by a "flesh-flesh" seal, the sealed strip forming the transverse joint of the package, the sealing hem allowing the sheet to be doubled in the sealing area of the transverse joint, each sheet of the blank being sealed longitudinally along a longitudinal base joint thereby defining an internal cavity suitable for containing a food products, the food product being poured into the inner cavity, and the package being closed by longitudinally sealing the sheet to itself along a longitudinal top joint spaced from the longitudinal base joint, the transverse joint extending from one longitudinal joint to the other, and wherein the tongue has a free gripping end, the sheet having longitudinal tear guide strips, each opening at one end into a transverse edge of the sheet opposite the tongue and at another end into the free end of the tongue.

2. The package according to claim 1, wherein the sheet is predominantly made of paper, cardboard or plastic, or a complex comprising one or more layers of paper and plastic, or one or more layers of plastic and aluminium, or several layers of plastic, or one or more layers of paper, plastic and aluminium.

3. The package according to the claim 1, wherein the weakened portions of the sheet comprise at least four longitudinal weakened portions, four transverse weakened portions, and eight additional weakened portions, two of the four longitudinal weakened portions and the eight additional weakened portions being intended to form two longitudinal gussets or four points projecting longitudinally outwards from the two longitudinal joints.

4. The package according to the claim 1, having a partial parallelepiped shape formed by four faces and two longitudinal gussets or four points projecting longitudinally outwards from the two longitudinal joints.

5. The package according to claim 3, having a parallelepiped shape in which the two longitudinal gussets or the four points projecting longitudinally outwards from the two longitudinal joints are folded over.

6. The package according to the claim 1, wherein the sheet has at least two primers to facilitate the opening of the package, the transverse joint being tearable.

7. A method for manufacturing and filling at least one package for a food product, comprising at least the following steps:

a step of providing a blank of a plurality of sheets secured to one another by a longitudinal edge, each sheet being intended to form a package each sheet having weakened portions comprising transverse weakened portions, and a tongue secured to a transverse edge of the sheet, the tongue having a free gripping end, the sheet having longitudinal tear guide strips, each opening at one end into a transverse edge of the sheet opposite the tongue and at another end into the free end of the tongue, a step of folding the blank or each sheet along the transverse weakened portions of each sheet to form a tube of rectangular cross-section and transversely sealing the blank to itself or each sheet to itself to form a peelable or tearable transverse joint, the tongue of each sheet projecting longitudinally from the transverse joint, wherein the sheet further has a transverse weakened portion along which the sheet is folded towards the outside of the package to form a sealing hem under the transverse joint, the tongue has an end bonded to a strip and a free end, the tongue and the strip are folded over the rear side of the package along a transverse weakened portion and the strip is sealed to the sealing hem by a "flesh-flesh" seal, the sealed strip forming the transverse joint of the package, the sealing hem allowing the sheet to be doubled in the sealing area of the transverse joint, and, for each sheet, a step of longitudinally sealing each sheet to form a longitudinal base joint thereby defining an inner cavity suitable for containing a food product, a step of filling the inner cavity with food product, and a step of closing the package by longitudinally sealing the sheet to itself to form a longitudinal top joint spaced from the longitudinal base joint.

8. The method for manufacturing and filling according to claim 7, further comprising, simultaneously with or after the step of closing the package an additional step of separating two successive packages by cutting.

9. The method for manufacturing and filling according to claim 7, further comprising, simultaneously with or after the step closing the package, an additional step forming a longitudinal pre-cut between two successive packages.

10. The method for manufacturing and filling according to claim 7, wherein in the filling step the food product is poured in a liquid or viscous state and solidifies in the package.

11. The method for manufacturing and filling according to claim 7, wherein the blank is supplied in reel form, the method further comprising, prior to the step of folding the blank, a sub-step of unwinding the blank, and, for each sheet a sub-step of forming tear guide strips, a sub-step of forming the weakened portions, a sub-step of forming the tongue and optionally of forming primers (68, 69).

12. A food product package obtainable by the manufacturing method according to claim 7.

13. A blank with a plurality of sheets for forming at least one package according to claim 8, wherein each sheet of the plurality of sheets has weakened portions comprising transverse weakened portions, and a tongue secured to a transverse edge of the sheet.

* * * * *